US005342486A

United States Patent [19]

Jeffery et al.

[11] Patent Number: 5,342,486

[45] Date of Patent: Aug. 30, 1994

[54] ENDLESS BELT FOR EXTENDED NIP DEWATERING PRESSES

[75] Inventors: John Jeffery, Blackburn; Leslie Y. Kaniuka, Bolton; Ian C. Sayers, Preston, all of England

[73] Assignee: Scapa Group PLC, Blackburn, England

[21] Appl. No.: 946,459

[22] PCT Filed: Jul. 5, 1991

[86] PCT No.: PCT/GB91/01104

§ 371 Date: Nov. 17, 1992

§ 102(e) Date: Nov. 17, 1992

[87] PCT Pub. No.: WO92/02677

PCT Pub. Date: Feb. 20, 1992

[30] Foreign Application Priority Data

Jul. 28, 1990 [GB] United Kingdom ..... 9016619

[51] Int. Cl.[5] ..... D21F 3/02

[52] U.S. Cl. ..... 162/358.4; 24/35; 162/904; 428/295; 156/304.3

[58] Field of Search ..... 162/358.4, 901, 904; 428/167, 295; 156/304.3, 304.5, 304.1; 24/31 R, 31 F, 31 W, 35

[56] References Cited

U.S. PATENT DOCUMENTS

| | | | |
|---|---|---|---|
| 3,617,442 | 11/1971 | Hurschman | 162/212 |
| 4,482,430 | 11/1984 | Majaniemi | 162/358.4 |
| 4,559,258 | 12/1985 | Kiuchi | 162/358.4 |
| 4,740,409 | 4/1988 | Lefkowitz | 428/131 |
| 4,973,383 | 11/1990 | Filzen | 162/901 |
| 5,167,771 | 12/1992 | Sayers et al. | 162/901 |

FOREIGN PATENT DOCUMENTS

| | | |
|---|---|---|
| 674961 | 7/1966 | France . |
| WO8605219 | 9/1986 | PCT Int'l Appl. . |
| WO8702080 | 4/1987 | PCT Int'l Appl. . |
| 2221702 | 2/1990 | United Kingdom . |

*Primary Examiner*—Karen M. Hastings

*Attorney, Agent, or Firm*—Keck, Mahin & Cate

[57] ABSTRACT

An extended nip press belt having a longitudinal running direction for the press-section of a papermaking machine includes an apertured membrane having two opposite faces and an impermeable coating layer at at least one face thereof. The material of the coating layer of layers engaging the apertures in the membrane extend at least to the plane of the face of the membrane opposite the one face. The membrane may include reinforcing yarns in the longitudinal running direction of the belt.

10 Claims, 3 Drawing Sheets

ENDLESS BELT FOR EXTENDED NIP DEWATERING PRESSES

The invention concerns improvements in or relating to extended nip dewatering presses and has more particular reference to a belt for use in the context of such presses.

In the press section of a papermaking machine or the like the paper web, interposed between two moisture-absorbing felts, moves in pressure contact with a press roll, being urged into such contact by a pressure shoe acting through a belt in contact with the outermost, in relation to the press roll, of the moisture absorbing felts.

The pressures applied by the shoe and the need to maximise removal of water from the paper web impose limitations on belt design, and the primary object of the present invention is to provide a belt for an extended nip press which will be capable of withstanding the pressures to which it will be subjected in use without substantial prejudice to the water conveying capabilities thereof.

The object of the invention is to provide an alternative belt for an extended nip dewatering press to that disclosed in our United Kingdom Patent Application No. 2221702.

SUMMARY OF THE INVENTION

According to the present invention there is proposed an extended nip press belt for the press-section of a papermaking machine or the like, the belt comprising an apertured membrane and an impermeable coating layer at at least one face thereof, the material of the coating layer or layers engaging the apertures in the said membrane and, in the case of a belt having a coating layer at one face only of the membrane, extending at least to the plane of the face of the membrane opposite the said at least one face, the membrane including reinforcing yarns in the running direction of the belt.

According to a preferred feature, in the case of a belt having a coating layer at one face only of the membrane, the material of the coating layer extends through the apertures in the membrane beyond the plane of the face of the membrane opposite the said at least one face.

According to a further preferred feature, the material of the coating layer extends through the apertures in the membrane to form discrete protuberances at the said opposite face, each said protuberance corresponding to a respective aperture in the membrane and the protuberances collectively defining a regularly profiled surface to the belt.

According to another feature of the invention, a coating layer is provided at each face of the membrane, the coating layers being in mutual contact through the membrane and being in fused relationship one with the other.

According to yet another feature of the invention the belt is of endless form and includes an apertured membrane piece having reinforcing yarns therein extending in a direction corresponding to the running direction of the belt, the membrane piece spanning abutting ends of an open-ended belt.

BRIEF DESCRIPTION OF THE DRAWINGS

The invention will now be described further, by way of example, only, with reference to the accompanying diagrammatic drawings in which.

DETAILED DESCRIPTION OF THE DRAWINGS

Figure 1:
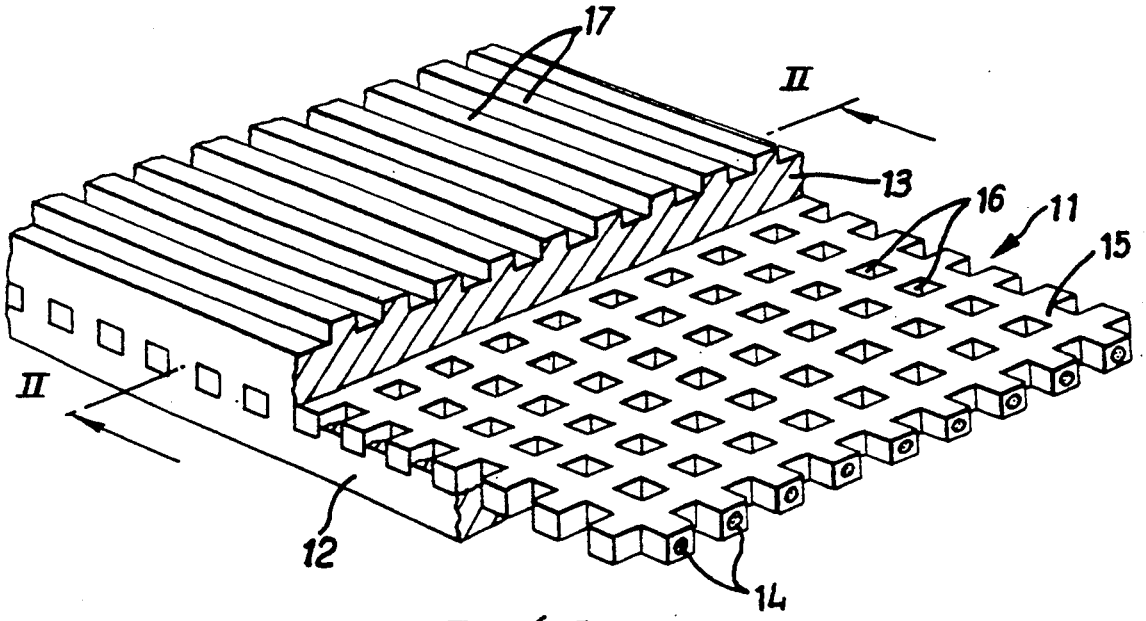
FIG. 1 is a perspective view, partly cut away, showing a first embodiment of the invention.
Figure 2:
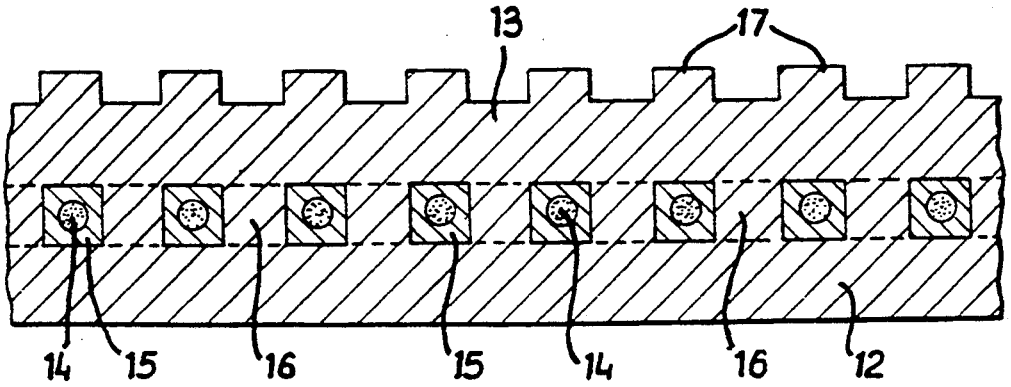
FIG. 2 is a section on line II—II of FIG. 1, drawn to a larger scale.

Referring now to the drawings, and in particular to FIGS. 1 and 2 thereof, an ENP belt comprises an apertured membrane 11 provided with facing layers 12, 13 of a thermoset polyurethane material.

Membrane 11 is produced in accordance with the method disclosed in United Kingdom Patent Specification No. 2202873 and includes reinforcing yarns 14, for example of polyester or polyamide monofilament or multifilament material extending in the running direction of the belt, the reinforcing yarns being positioned in the lands 15 existing between adjacent apertures 16. The apertures 16 are conveniently 1 mm square, the lands suitably being of the same width, and have a slight taper, the membrane being 1 mm thick.

Of the facing layers 12, 13, layer 12, being the layer at that side of the belt intended for contact with the shoe, has a smooth surface and can be of a softer polyurethane material than layer 13, thereby to minimise the creation of an oil mist in moving over the shoe.

Facing layer 13 presents ribs 17 for engagement with the press felt.

The polyurethane material which forms facing layers 12, 13 is an isocyanate/polyol system and is applied to the membrane by means of a spraying technique, the material of one or both of such layers passing into the apertures 16 to form a mechanical bond with the membrane. However, alternatives to the isocyanate/polyol system may be used for example an isocyanate/polyurea system is believed to be of application to the context of the invention. Furthermore, instead of spraying, a cast system or a knife over roller coating technique may be employed, such systems reducing the incidence of air bubbles in the finished product.

Figure 3:
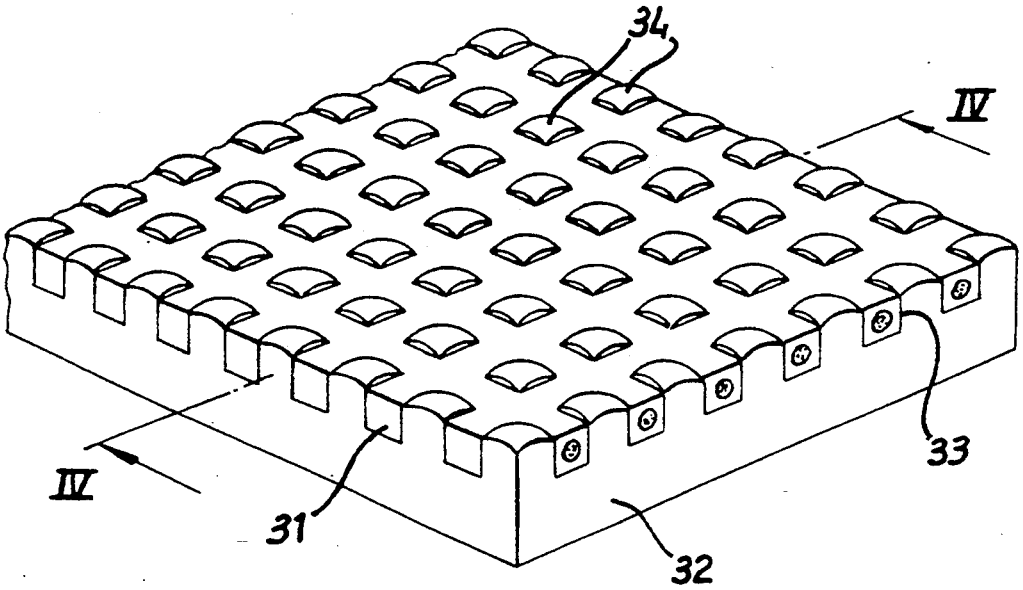
FIG. 3 is a view corresponding to FIG. 1 and shows a second embodiment of the invention.
Figure 4:
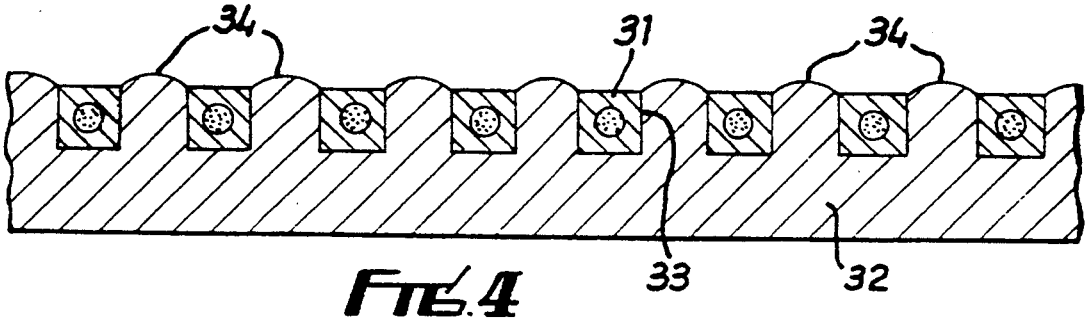
FIG. 4 is a section taken on line IV—IV of the embodiment shown in FIG. 3.

In a second embodiment of the invention as shown in FIGS. 3 and 4, a membrane 31 of similar form to that of the embodiment of FIGS. 1 and 2 is provided with a facing layer 32 at one side only thereof, the material of facing layer 32 extending through the apertures 33 to form protuberances 34 at the opposite side of the membrane 31 which stand proud of the corresponding plane of said membrane to define a profiled surface configuration or comparable surface effect to the ribs 17 as shown in FIG. 1.

The planar membrane shown in FIGS. 1 and 2 and in FIGS. 3 and 4 includes reinforcing yarns 14 (FIG. 2) extending in the running direction of the belt. If desired, further yarns (not shown) may be provided within those lands which extend in the transverse direction of the membrane. The membrane may, however, also include additional reinforcement in the running direction, such additional reinforcement comprising yarns of T-shaped transverse cross-section arranged in inverted disposition with the limb thereof extending outwardly from the membrane.

Figure 5:
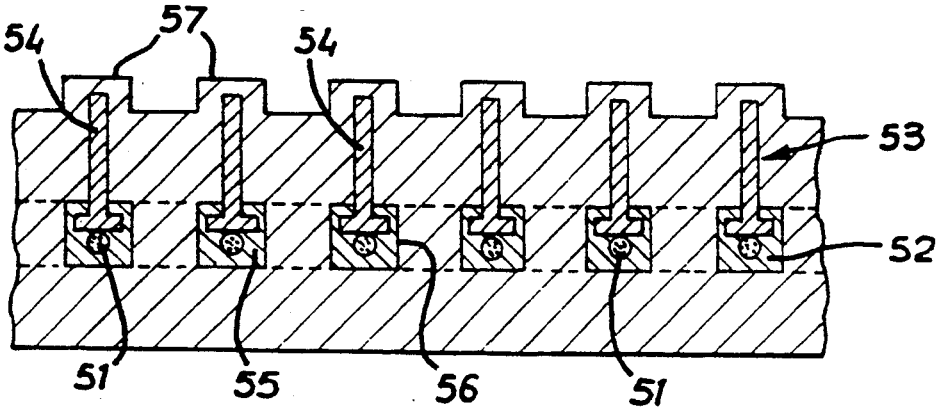
FIG. 5 is a view corresponding to FIG. 2 and shows a modified form of the embodiment shown therein.

Thus, referring now to FIG. 5, in a further embodiment, in addition to the longitudinally extending monofilament or multifilament polyester or polyamide yarns 51, the membrane 52 further includes additional reinforcement in the form of profiled yarns 53 of T-shaped transverse cross-section, the profiled yarns being arranged in inverted disposition with the limb 54 thereof extending outwardly from the lands 55 between adjacent apertures 56. As is apparent from the drawing, the profiled yarns 53 exist in register with the ribs 57 provided at the felt side of the belt and thereby provide a reinforcement for such ribs.

In the modification of the arrangement shown in FIG. 5, the longitudinally extending yarns 51 are omitted and reliance is placed on the reinforcement provided by the profiled yarns.

In order to provide an endless belt, the membrane may be brought into endless form before application of the facing layer or layers, a suitable manner in which joining of the ends might be effected being disclosed in our copending United Kingdom Patent Application No. 2231838.

Figure 6:
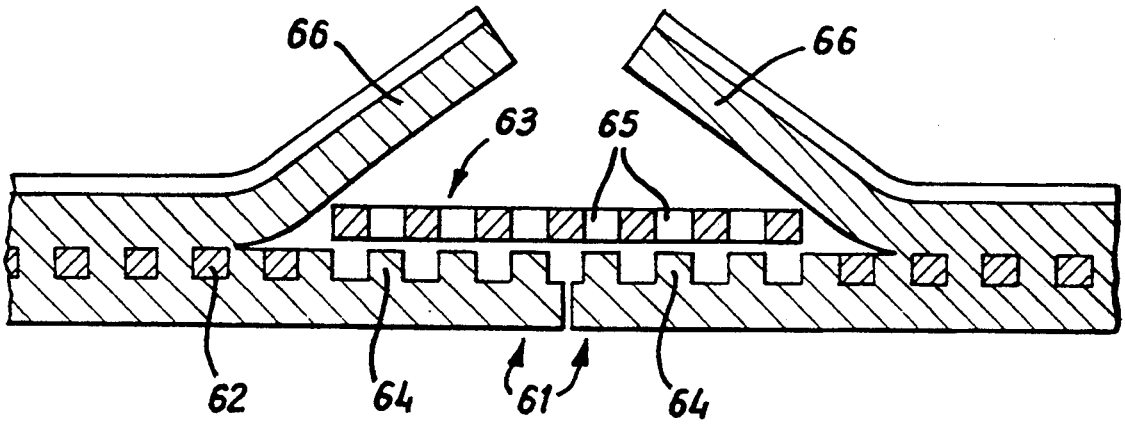
FIG. 6 illustrates one manner in which the ends of the embodiment of FIGS. 1 and 2 may be joined together to form an endless belt.
Figure 7:
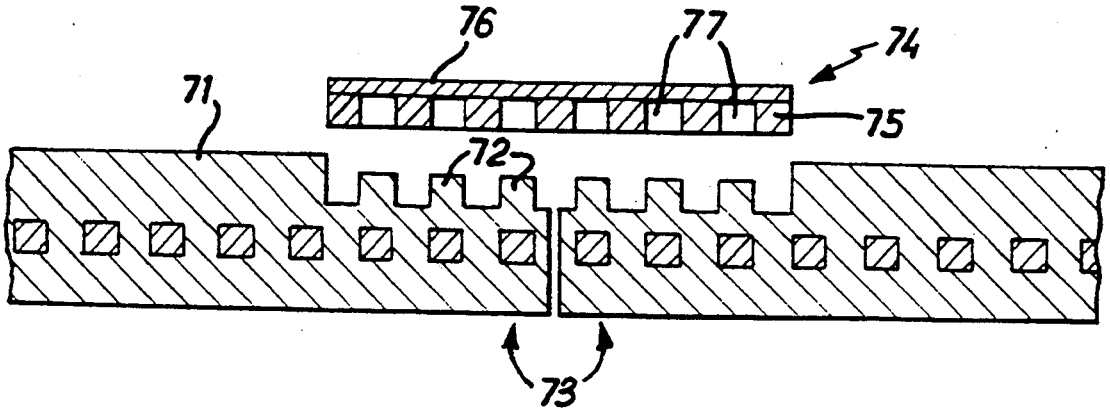
FIG. 7 is a view corresponding to FIG. 6 and shows an alternative way in which fabric ends may be joined.

However, alternatives to the method disclosed in our copending application aforesaid do lend themselves to the context of coated belts of the kind herein proposed, and typical joints are shown in FIGS. 6 and 7.

Thus, in the case of the arrangement shown in FIG. 6, each belt end 61 is slit along the plane of one face of the membrane 62 at each fabric end and the membrane is cut transversely of the belt in spaced disposition with respect of the belt extremity, the end of the membrane existing beyond the line of cut then being peeled off. The belt ends 61 are brought into abutment and are maintained in such disposition by engaging a membrane piece 63 having reinforcing yarns extending in the running direction of the belt with the multiplicity of upstanding lugs 64, each of such lugs having a configuration closely complementary to that of the apertures 65 in the membrane piece 63, the flaps 66 existing at the fabric ends then being laid flat on the membrane piece 63 and being secured thereto as by means of an adhesive and/or by the application of heat.

In a further alternative, see now FIG. 7, a short length of membrane (not shown) is applied to the surface of the coating layer 71 in the end region of the belt and whilst the coating layer is fluid, such membrane being peeled off when the material of the layer has hardened thereby to leave upstanding lugs 72.

The belts ends 73 are then brought into abutment and a jointing element 74 and the adjacent regions of the belt being heated to effect fusion between the jointing element and the material of the belt. If desired, any suitable adhesive may be applied to the mating faces of the regions to be joined.

It is to be appreciated that, if desired, a coupling agent/adhesion promoter may be utilised to enhance the bond between the membrane, whether it be the membrane used for joining together the fabric ends or otherwise, and the coating material, thereby the reduce the likelihood of delamination.

The invention is not restricted to the exact detail of the embodiment hereinbefore described, since alternatives will readily present themselves to one skilled in the art.

Thus, for example, the membrane may be of different dimensions from those herein set forth and may include reinforcing yarns of other than circular configuration.

Although in the foregoing embodiments the felt side of the belt has been described as having a ribbed or profiled surface, the invention is not limited to structures having such feature, and is equally applicable to ENP belts wherein both the shoe side and the fabric side are planar.

We claim:

1. An extended nip press belt having a longitudinal running direction for the press-section of a papermaking machine, the belt comprising an apertured membrane having two opposite faces and an impermeable coating layer on at least one face thereof, the material of the coating layer at said at least one face engaging the apertures in said membrane and extending at least to the plane of the face of the membrane opposite said at least one face, the membrane including reinforcing yarns in the longitudinal running direction of the belt.

2. A belt as claimed in claim 1, wherein the membrane further includes reinforcing yarns extending in a direction transverse to the longitudinal running direction of the belt.

3. A belt as claimed in claim 1, including an apertured membrane piece having reinforcing yarns therein extending in a direction corresponding to the longitudinal running direction of the belt, the membrane piece spanning abutting ends of said belt, whereby said belt is brought into endless form.

4. A belt as claimed in claim 3, wherein the membrane piece is positioned intermediate and spaced from the outer surfaces of the belt.

5. An extended nip press belt having a longitudinal running direction for the press-section of a papermaking machine, the belt comprising an apertured membrane having two opposite faces, wherein an impermeable coating layer is provided at each face of the membrane, the coating layers being in mutual contact through the apertures in said membrane and being in fused relationship one with the other, the membrane including reinforcing yarns in the longitudinal running direction of the belt.

6. A belt as claimed in claim 5, wherein the coating layer at one face is of a softer coating material than that present at the face of the membrane opposite said one face.

7. A belt as claimed in claim 5, wherein the reinforcing yarns extending in the longitudinal running direction of the belt comprise profiled yarns extending outwardly from the plane of the membrane and the belt includes ribs arranged in register with the said profiled yarns and within which said yarns are embedded.

8. A belt as claimed in claim 7, wherein said profiled yarns define further reinforcing yarns additional to yarns existing in and extending longitudinally of the membrane.

9. A extended nip press belt having a longitudinal running direction for the press-section of a papermaking machine, the belt comprising an apertured membrane having two opposite faces and an impermeable coating layer at one face only of the membrane, the material of the coating layer engaging the apertures in said membrane, wherein the material of the coating layer extends through the apertures in the membrane beyond the plane of the face of the membrane opposite said one face, the membrane including reinforcing yarns in the longitudinal running direction of the belt.

10. A belt as claimed in claim 9, wherein the material of the coating layer extends through the apertures in the membrane to form discrete protuberances at said opposite face, each said protuberance corresponding to a respective aperture in the membrane and the protuberances collectively defining a regularly profiled surface to the belt.

* * * * *